US007841501B2

(12) United States Patent
Panasik et al.

(10) Patent No.: US 7,841,501 B2
(45) Date of Patent: Nov. 30, 2010

(54) COVER OR BOOT FOR THE NAIL ADVANCEMENT MECHANISM OF A FASTENER-DRIVING TOOL

(75) Inventors: Cheryl L. Panasik, Elburn, IL (US); Louis Thomas, Maywood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 128 days.

(21) Appl. No.: 12/078,470

(22) Filed: Mar. 31, 2008

(65) Prior Publication Data

US 2009/0242605 A1 Oct. 1, 2009

(51) Int. Cl.
*B25C 1/00* (2006.01)

(52) U.S. Cl. ..... 227/120; 227/127

(58) Field of Classification Search ..... 227/120, 227/127, 135; 220/799
See application file for complete search history.

(56) References Cited

U.S. PATENT DOCUMENTS

| | | | | | |
|---|---|---|---|---|---|
| 4,154,434 | A * | 5/1979 | Wallis | 264/119 |
| 4,286,950 | A * | 9/1981 | Hawk | 433/116 |
| 4,660,610 | A * | 4/1987 | McIntire, III | 206/349 |
| 4,854,428 | A * | 8/1989 | Horvath | 188/298 |
| 4,942,996 | A * | 7/1990 | Wolfberg et al. | 227/136 |
| 4,981,247 | A * | 1/1991 | Noll | 227/156 |
| 5,006,740 | A * | 4/1991 | Palm | 310/50 |
| 5,182,956 | A * | 2/1993 | Woodall et al. | 74/18.2 |
| 5,338,195 | A * | 8/1994 | Flannagan | 433/116 |
| 5,996,874 | A * | 12/1999 | Fukushima et al. | 227/8 |
| 6,032,848 | A | 3/2000 | Smolinski | |
| 6,170,730 | B1 | 1/2001 | Lin | |
| 6,199,383 | B1 * | 3/2001 | Pusateri | 60/695 |
| 2004/0132354 | A1 * | 7/2004 | Nayrac et al. | 439/894 |

FOREIGN PATENT DOCUMENTS

| | | |
|---|---|---|
| CA | 2031043 | 5/1995 |
| DE | 2 158674 | 6/1973 |

* cited by examiner

*Primary Examiner*—Rinaldi I Rada
*Assistant Examiner*—Nathaniel Chukwurah
(74) *Attorney, Agent, or Firm*—Law Offices of Steven W. Weinrieb

(57) ABSTRACT

A cover or boot for use in conjunction with the nail advancement mechanism of a fastener-driving tool is disclosed. The cover or boot covers external surface portions of the nail advancement mechanism of the fastener-driving tool so as to prevent a significant accumulation of dust particles from effectively collecting upon and entering the piston-cylinder assembly of the nail advancement mechanism and thereby operatively interfering with the reciprocal movements of the piston of the piston-cylinder assembly of the nail advancement mechanism whereby the operative functioning of the nail advancement mechanism of the fastener-driving tool would otherwise be adversely affected.

18 Claims, 8 Drawing Sheets

COVER OR BOOT FOR THE NAIL ADVANCEMENT MECHANISM OF A FASTENER-DRIVING TOOL

FIELD OF THE INVENTION

The present invention relates generally to fastener-driving tools, and more particularly to a new and improved cover or boot for use in conjunction with the nail advancement mechanism of a fastener-driving tool wherein the cover or boot substantially encloses, encases, or covers substantial external surface portions of the nail advancement mechanism of the fastener-driving tool so as to prevent a significant deposit, collection, or accumulation of dust, debris, particles, or the like, generated as a result of fasteners being driven into various different substrates, such as, for example, gypsum or other types of wallboard, from effectively collecting upon and entering the piston-cylinder assembly of the nail advancement mechanism and thereby fouling or otherwise operatively interfering with the reciprocal movements of the piston rod of the piston-cylinder assembly of the nail advancement mechanism whereby the operative functioning of the nail advancement mechanism of the fastener-driving tool would otherwise be adversely affected whereby, for example, nail fasteners may not be properly advanced at proper times during the fastener-driving cycles, the nail fasteners may become jammed within the fastener-driving tool so as to prevent the proper firing of the fastener-driving tool, more frequent maintenance of the fastener-driving tool would be required, and the like.

BACKGROUND OF THE INVENTION

Various different fastener-driving tools are of course well known in the art. It is also known in the art that these various different fastener-driving tools are operated by means of different power sources, that is, for example, some fastener-driving tools may be combustion-powered, some fastener-driving tools may be driven by compressed air, and the like. One example of a combustion-powered fastener driving tool is disclosed within U.S. Patent Re. 32,452 which issued to Nikolich on Jul. 7, 1987. Regardless of the type of power source utilized to operate such fastener-driving tools, when fasteners are driven into various different substrates, dust, particles, debris, or the like, are likely to be generated. This type of event occurs substantially naturally as a function of the particular material from which the particular substrate is fabricated. For example, this type of event is quite common when fasteners are driven into, for example, gypsum or other similar types of wallboard. One of the problems that needs to be confronted or resolved when such dust, particles, debris, or the like, are in fact generated, resides in the fact that the dust, particles, debris, or the like, are effectively widely dispersed or disseminated and tend to coat, collect, or accumulate upon various different surface portions of the fastener-driving tool, or even more importantly, that the dust, particles, debris, or the like, can normally enter internal regions of the fastener-driving tool. The ingress of such dust, particles, debris, or the like, into the internal regions of the fastener-driving tool can lead to various operational problems within the fastener-driving tool.

More particularly, if the dust, particles, debris, or the like, should enter specific internal regions of the fastener-driving tool, such as, for example, into the piston-cylinder assembly of the nail advancement mechanism of the fastener-driving tool, which mechanism is normally or conventionally exposed, the dust, particles, debris, or the like, could foul or otherwise operatively interfere with the reciprocal movements of the piston rod of the piston-cylinder assembly of the nail advancement mechanism whereby the operative functioning of the nail advancement mechanism of the fastener-driving tool would be adversely affected. The reason for this is that not only can the dust, particles, debris, or the like, accumulate within the nail advancement mechanism so as to operatively interfere with the reciprocal movements of the piston rod of the piston-cylinder assembly of the nail advancement mechanism, but in addition, the dust, particles, debris, or the like, can also effectively become mixed or combined with, or become embedded within, the various lubricants that are normally used upon the piston and piston rod structure of the piston-cylinder assembly so as to effectively ensure the smooth reciprocal movements of the piston and the piston rod with respect to its surrounding cylinder. If such events do occur, then the nail fasteners may not be properly advanced at proper times during the fastener-driving cycles, the nail fasteners may become jammed within the fastener-driving tool so as to prevent the proper firing of the fastener-driving tool, more frequent maintenance of the fastener-driving tool would be required, and the like.

A need therefore exists in the art for a new and improved means or structure for effectively covering, encasing, or enclosing, for example, substantial external surface portions of the nail advancement mechanism of the fastener-driving tool so as to effectively prevent the collection or accumulation of dust, particles, debris, or the like, generated during the driving of fasteners into particular types of substrates, upon such external surface portions of the nail advancement mechanism of the fastener-driving tool and therefore, in turn, effectively prevent the ingress of such dust, particles, debris, or the like into the internal regions of the fastener-driving tool, and more particularly, into the internal regions of the nail advancement mechanism of the fastener-driving tool, so as to effectively prevent the occurrence of the aforenoted events which could adversely affect the cyclical operations of the fastener-driving tools.

SUMMARY OF THE INVENTION

The foregoing and other objectives are achieved in accordance with the teachings and principles of the present invention through the provision of a new and improved cover or boot for a fastener-driving tool, and more particularly to a new and improved cover or boot for the nail advancement mechanism of the fastener-driving tool wherein the cover or boot covers, encases, or encloses substantial external surface portions of the nail advancement mechanism of the fastener-driving tool so as to effectively prevent the deposit, collection, or accumulation of dust, particles, debris, or the like, generated during the driving of fasteners into particular types of substrates, upon such external surface portions of the nail advancement mechanism of the fastener-driving tool, and to subsequently prevent the ingress of such deposited, collected, or accumulated debris, dust, particles, or the like, into the internal regions of the nail advancement mechanism of the fastener-driving tool, so as to effectively prevent the occurrence of the aforenoted events which could adversely affect the cyclical operations of the fastener-driving tools. The cover may comprise, in effect, a boot fabricated, for example, from a suitable rubber material, such as, for example, butadiene or neoprene, or alternatively, the cover may comprise, in effect, a cover fabricated, for example, from a relatively hard thermoplastic material, such as, for example, NYLON® or the like.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
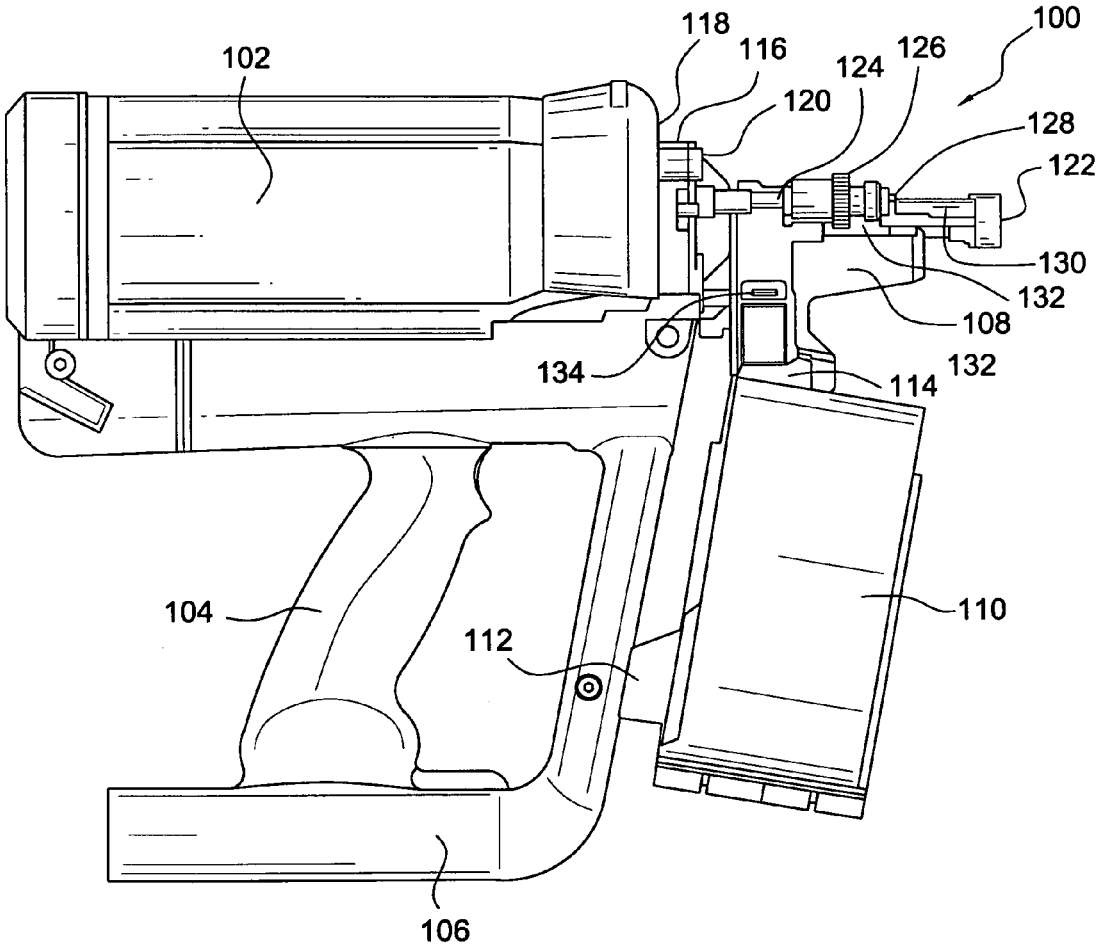
FIG. 1 is a side elevational view of a fastener-driving tool which has a nosepiece assembly mounted thereon and upon which a nail advancement mechanism is adapted to be mounted between the fastener magazine of the fastener-driving tool and the working piston-driver blade assembly of the fastener-driving tool in order to serially advance leading fasteners, disposed within the fastener magazine, to a position at which the driver blade mechanism of the fastener-driving tool can impact the fastener so as to in fact drive and discharge the fastener out from the fastener-driving tool.

Referring now to the drawings, and more particularly to FIG. 1 thereof, a fastener-driving tool is disclosed and is generally indicated by the reference character 100. More particularly, it is seen that the fastener-driving tool 100, which may comprise, for example, a combustion-powered fastener-driving tool, comprises a housing 102 within which there is disposed, for example, a combustion chamber, a working piston, a piston cylinder, and a driver blade or mechanism for driving a fastener out from the fastener-driving tool 100 and into a substrate or workpiece. A handle 104 is provided for grasping the fastener-driving tool 100, and it is to be appreciated that the handle 104 has a suitable tool-firing trigger mechanism, not clearly visible, mounted thereon. In addition, the fastener-driving tool 100 further comprises a framework 106 which effectively fixedly supports or mounts the housing 102 and the handle 104 thereon, as well as integrally connects the various components parts of the fastener-driving tool 100 together.

Continuing further, a nosepiece assembly is illustrated at 108, and it is seen that a fastener magazine 110, for housing or containing a supply of fasteners to be discharged out from the fastener-driving tool 100 and driven into the workpiece or substrate, is adapted to be fixedly mounted upon the framework 106 by means of, for example, a first mounting bracket 112, and is also adapted to be fixedly mounted upon the nosepiece assembly 108 by means of, for example, a second mounting bracket 114. While different fastener-driving tools may be provided with differently configured fastener magazines, the particularly illustrated fastener-driving tool 100 is seen to have a cylindrically configured fastener magazine 110 fixedly secured thereon and within which, for example, a circular coil of, for example, a plurality of nail fasteners are adapted to be disposed, housed, and contained, wherein the nail fasteners are adapted to be serially or sequentially supplied or dispensed out from the fastener magazine 110 so as to be disposed at a position at which the driver blade or mechanism, not shown, but operatively associated with the working piston disposed within the piston cylinder of the housing 102, can effectively impact the particular fastener and thereby drive the same into the workpiece or substrate.

It is also seen that an adaptor plate 116 is adapted to be interposed between the rear end portion of the nosepiece assembly 108 and the front end or front face portion 118 of the housing 102 so as to effectively fixedly mount the nosepiece assembly 108 upon the front end or front face portion 118 of the housing 102. Accordingly, a plurality of, for example, bolt fasteners 120 are adapted to be threadedly engaged within threaded bores defined within the front end or front face portion 118 of the housing 102 so as to fixedly mount the nosepiece assembly 108 and the adaptor plate 116 onto the front end or front face portion 118 of the housing 102. A workpiece contact element 122 is provided upon the nosepiece assembly 108 for engaging the substrate or work-piece into which the fastener is to be driven, and as is conventional, the workpiece contact element 122 is operatively connected to the trigger mechanism of the fastener-driving tool 100 such that the tool can only be fired in accordance with particular firing modes of operation of the fastener-driving tool 100 for the safety of operator personnel. The workpiece contact element 122 is also adapted to be adjustably mounted upon the fastener-driving tool 100 so as to effectively alter or adjust the distance of the fastener-driving tool 100, and the fastener driver blade mechanism thereof, from the workpiece or substrate so as to, in turn, alter or adjust the depth to which the fastener will be driven into the substrate or workpiece.

More particularly, a thumbwheel mounting assembly 124 is fixedly mounted upon the nosepiece assembly 108, and an internally threaded thumbwheel 126 is rotatably mounted upon the thumbwheel mounting assembly 124. The workpiece contact element 122 is integrally disposed upon a first distal or free end portion of a substantially Z-shaped arm or bracket 128, while the second opposite end portion of the substantially Z-shaped arm or bracket 128 is externally threaded, not visible, so as to be able to be threadedly engaged within the internally threaded thumbwheel 126. Accordingly, depending upon the direction in which the thumbwheel 126 is rotated, the disposition of the substantially Z-shaped bracket or arm 128, and therefore, the disposition of the workpiece contact element 122 disposed upon the distal or free end portion of the substantially Z-shaped arm or bracket 128, will be adjustably moved with respect to the forward portion of the fastener-driving tool 100. It is to be further noted that the workpiece contact element 122 is actually mounted upon, or affixed to, an axially oriented section 130 of the substantially Z-shaped arm or bracket 128, and that the undersurface portion of the axially oriented section 130 of the substantially Z-shaped arm or bracket 128 has a substantially semi-cylindrical concave cross-sectional contour or configuration. In a similar manner, the nosepiece assembly 108 is provided with an axially oriented guide rail 132 which correspondingly has a substantially semi-cylindrical convex cross-sectional contour or configuration. Accordingly, the undersurface portion of the axially oriented section 130 of the substantially Z-shaped arm or bracket 128, having the substantially semi-cylindrical concave cross-sectional contour or configuration, effectively rides upon the external surface portion of the axially oriented guide rail 132, having the substantially semi-cylindrical convex cross-sectional contour or configuration, in order to properly support the workpiece contact element 122 when the disposition of the same is effectively being altered or adjusted by means of the thumbwheel 126.

A nail advancement mechanism, schematically illustrated at 133, is provided upon the fastener-driving tool 100 for serially advancing the leading one of the plurality of nail fasteners, disposed within the fastener magazine 110, out from the fastener magazine 110 such that the leading one of the plurality of nail fasteners will be properly positioned in preparation for being discharged from the fastener-driving tool 100. More particularly, the nail advancement mechanism 133 is adapted to be operatively mounted upon a platform section 134 of the nosepiece assembly 108 so as to be structurally interposed between the fastener magazine 110, and the position at which the driver blade or mechanism, not shown, of the fastener-driving tool 100 will effectively impact the particular fastener, so as to thereby advance the leading one of the fasteners out from the fastener magazine 110 and to the position at which the driver blade or mechanism, not shown, of the fastener-driving tool 100 will in fact impact the particular fastener and thereby drive the fastener out from the fastener-driving tool 100 and into the workpiece or substrate. The nail advancement mechanism 133 normally comprises a piston-cylinder assembly wherein a reciprocally moving piston member is disposed within a suitable cylinder housing. As has been noted hereinbefore, when fasteners are driven into various different substrates, dust, particles, debris, or the like, are normally generated. This type of event occurs substantially naturally as a function of the particular material from which the particular substrate is fabricated. For example, this type of event is quite common when fasteners are driven into, for example, gypsum or other similar types of wallboard. The dust, debris, particles, or the like, are effectively widely dispersed or disseminated, and tend to coat, collect, or accumulate upon various different surface portions of the fastener-driving tool. Even more importantly, the dust, particles, debris, or the like, can easily enter internal regions of the fastener-driving tool. The ingress of such dust, particles, debris, or the like, into the internal regions of the fastener-driving tool can lead to various operational problems within the fastener-driving tool.

More particularly, if the dust, particles, debris, or the like, should enter specific internal regions of the fastener-driving tool, such as, for example, into the afore-noted piston-cylinder assembly of the nail advancement mechanism 133 of the fastener-driving tool, wherein, as has been noted, the nail advancement mechanism 133 is mounted upon the platform section 134 of the nosepiece assembly 108 of the fastener-driving tool 100 so as to be normally or conventionally externally exposed, then such dust, particles, debris, or the like, could foul or otherwise operatively interfere with the reciprocal movements of the piston rod of the piston-cylinder assembly of the nail advancement mechanism 133 whereby the operative functioning of the nail advancement mechanism 133 of the fastener-driving tool 100 would be adversely affected. The reason for this is that not only can the dust, particles, debris, or the like, collect or accumulate within the nail advancement mechanism 133 so as to operatively interfere with the reciprocal movements of the piston rod of the piston-cylinder assembly of the nail advancement mechanism 133, but in addition, the dust, particles, debris, or the like, can also effectively become mixed or combined with, or become embedded within, the various lubricants that are normally used upon the piston and piston rod structure of the piston-cylinder assembly so as to effectively ensure the smooth reciprocal movements of the piston and the piston rod with respect to its surrounding cylinder. If such events do occur, then the nail fasteners may not be properly advanced at proper times during the fastener-driving cycles, the nail fasteners may become jammed within the fastener-driving tool 100 so as to prevent the proper firing of the fastener-driving tool 100, more frequent maintenance of the fastener-driving tool 100 would be required, and the like.

Therefore, in accordance with the principles and teachings of the present invention, a new and improved cover or boot has been developed which effectively covers, encases, or encloses the nail advancement mechanism 133 of the fastener-driving tool 100 so as to in fact effectively prevent the coating, collection, or accumulation of such dust, particles, debris, or the like, upon the nail advancement mechanism 133 of the fastener-driving tool 100. In turn, the new and improved boot or cover effectively prevents, or certainly retards, the ingress of such dust, particles, debris, or the like, into the internal regions of the nail advancement mechanism 133 so as to effectively prevent any fouling of, or operative interference with, the reciprocal movements of the piston member of the piston-cylinder assembly of the nail advancement mechanism 133 of the fastener-driving tool 100. More particularly, a first embodiment of a new and improved cover or boot, for use in conjunction with the nail advancement mechanism 133 of the fastener-driving tool 100 as disclosed within FIG. 1, is disclosed, for example, within FIGS. 2-9 and is designated by the reference character 200. The first embodiment cover or boot 200 is seen to comprise a molded structure which may be fabricated, for example, a from a suitable rubber material, such as, for example, butadiene, neoprene, or the like. Accordingly, it is relatively soft, resilient, pliable, flexible, and the like, and is adapted to substantially conform to the external structural contours, shapes, or configurations of the various component parts comprising the nail advancement mechanism 133, such as, for example, the cylinder housing and the piston rod of the piston member which is adapted to be reciprocally movable within the cylinder housing of the nail advancement mechanism 133, so as to in fact cover, enclose, or encase the same in a substantially sealed manner.

More particularly, it is seen that the first embodiment of the new and improved cover or boot 200 of the present invention comprises a central housing section 202 which defines an internal cylinder chamber 204 within which the cylinder of the piston-cylinder assembly of the nail advancement mechanism 133 is adapted to be housed or disposed, an upper housing section 206, as considered from the point of view of the orientation of the cover or boot 200 when the cover or boot 200 is disposed upon or over the nail advancement mechanism 133 so as to cover, enclose, or encase the same, wherein the upper housing section 206 of the cover or boot 200 defines an internal piston rod chamber 208 within which the piston rod of the piston-cylinder assembly of the nail advancement mechanism 133 is adapted to be housed or disposed when the piston rod of the piston-cylinder assembly of the nail advancement mechanism 133 is moved to its extended position with respect to the cylinder of the piston-cylinder assembly of the nail advancement mechanism 133, and a lower housing section 210, again, as considered from the point of view of the orientation of the cover or boot 200 when the cover or boot 200 is disposed upon or over the nail advancement mechanism 133 so as to cover, enclose, or encase the same, wherein the lower housing section 210 defines an internal chamber 212 within which a spring member of the nail advancement mechanism 133 is adapted to be housed or disposed. The spring member moves the piston, along with its piston rod, of the piston-cylinder assembly of the nail advancement mechanism 133, to its extended position.

Figure 2:
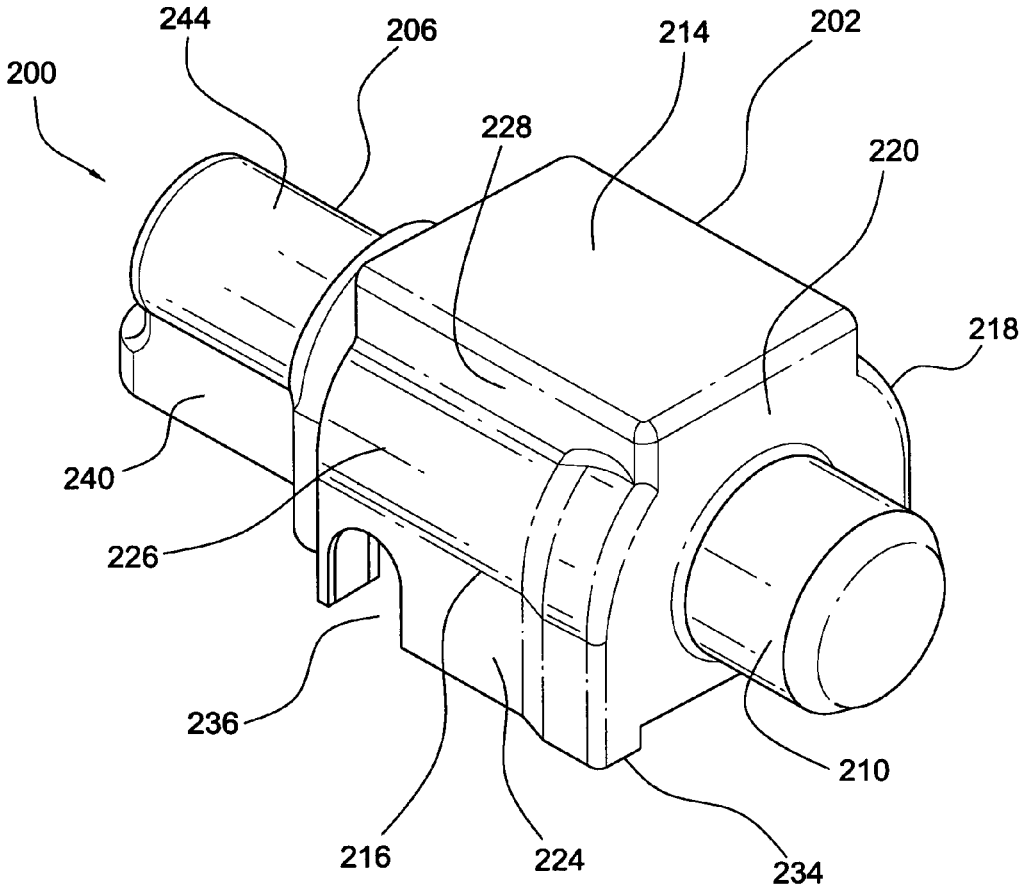
FIG. 2 is a perspective view of a first embodiment of a new and improved cover or boot, as constructed in accordance with the principles and teachings of the present invention and as viewed from the cylinder end and left side portion of the cover or boot, wherein the new and improved cover or boot has been mounted upon the fastener-driving tool so as to effectively cover the nail advancement mechanism of the fastener-driving tool so as to prevent dust, particles, debris, or the like, generated as a result of fasteners being driven into various different substrates, such as, for example, gypsum or other types of wallboard, from effectively entering the piston-cylinder assembly of the nail advancement mechanism and thereby fouling or otherwise operatively interfering with the reciprocal movements of the piston rod of the piston-cylinder assembly of the nail advancement mechanism.
Figure 4:
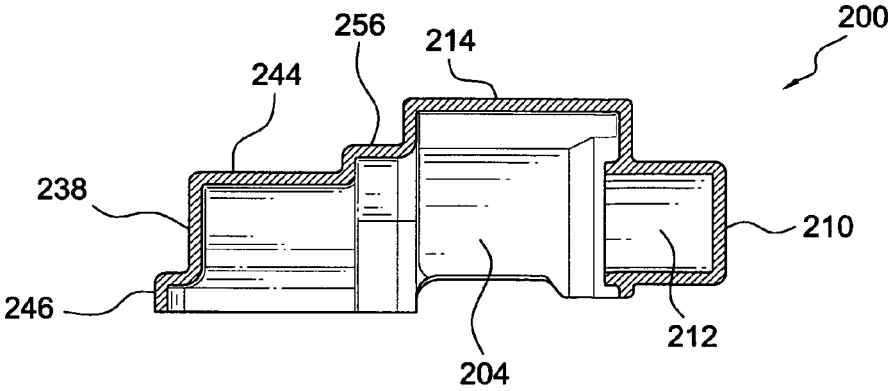
FIG. 4 is a cross-sectional view of the first embodiment of the new and improved cover or boot as illustrated within FIG. 3 and as taken along the lines 4-4 of FIG. 3.
Figure 3:
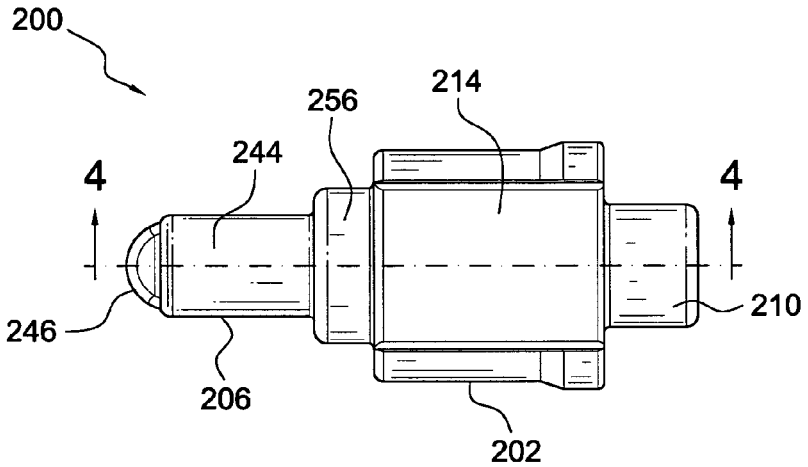
FIG. 3 is a top plan view of the first embodiment of the new and improved cover or boot as illustrated within FIG. 2.
Figure 5:
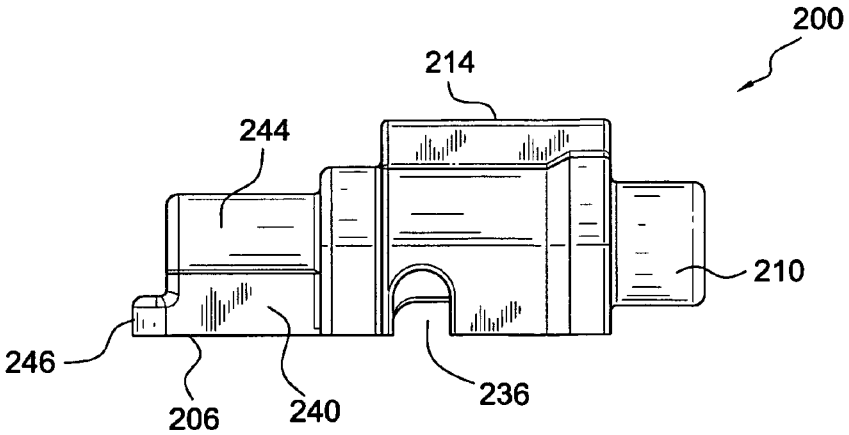
FIG. 5 is a left side elevational view of the first embodiment of the new and improved cover or boot as illustrated within FIGS. 2 and 3.
Figure 8:
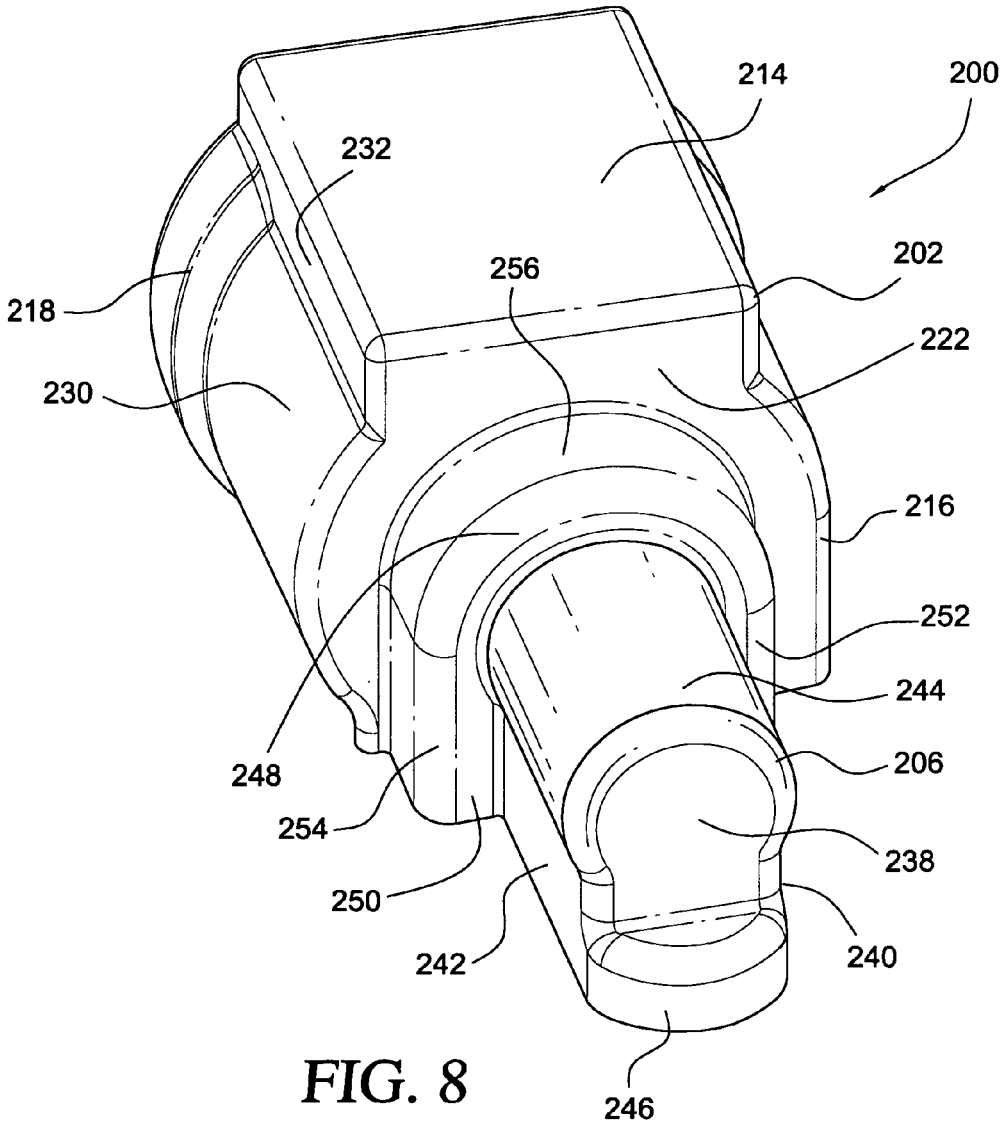
FIG. 8 is a perspective view of the first embodiment of the new and improved cover or boot as disclosed within FIG. 2 and as viewed from the piston end of the cover or boot.
Figure 9:
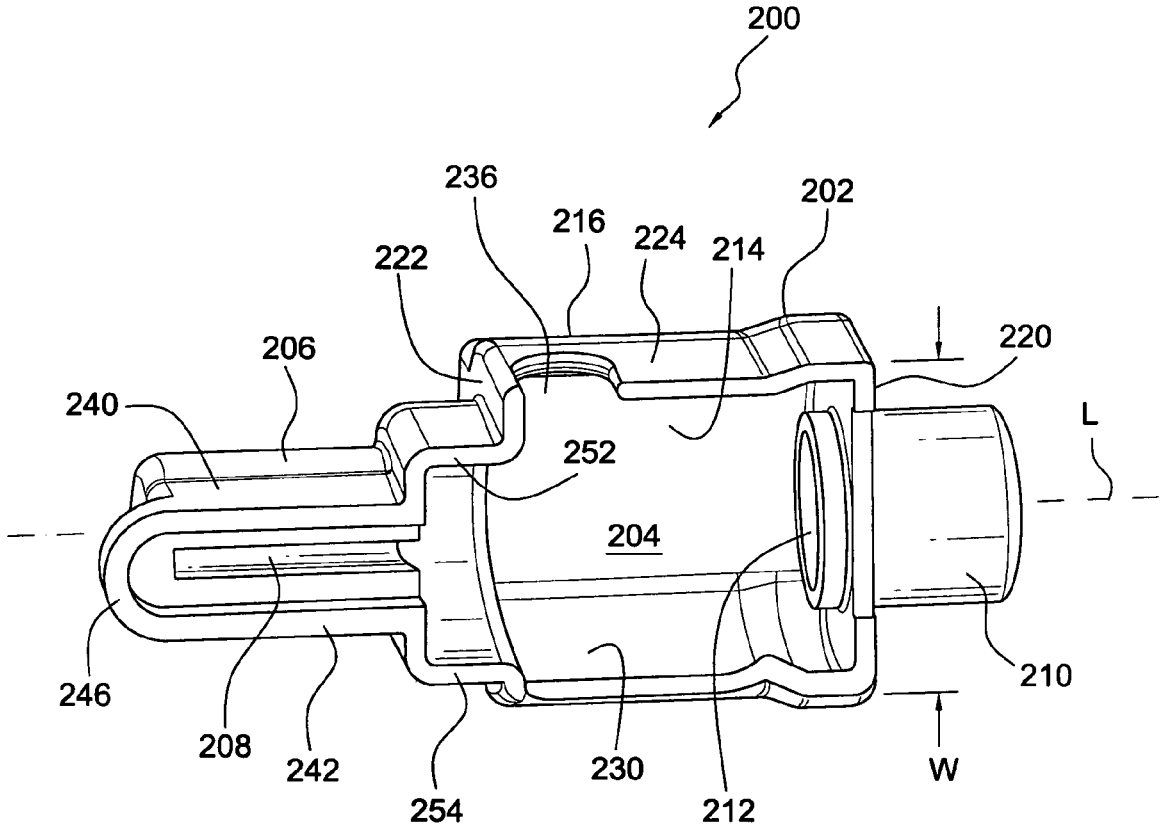
FIG. 9 is a bottom plan and perspective view of the first embodiment of the new and improved cover or boot as disclosed within FIG. 8.

Continuing further, and as can best be seen, for example, within FIGS. 2,8, and 9, the cover or boot 200 has a substantially shell-like structure so as to be capable of being simply disposed over the nail advancement mechanism 133 of the fastener-driving tool 100 in order to cover, encase, or enclose the same. Accordingly, for example, it is seen that the central housing section 202 of the cover or boot 200 of the present invention comprises a top wall member 214, a left side wall member 216, again, as considered from the point of view of the orientation of the cover or boot 200 when the cover or boot 200 is disposed upon or over the nail advancement mechanism 133 so as to cover, enclose, or encase the same, a right side wall member 218, a lower end wall member 220, and an upper end wall member 222.

Figure 6:
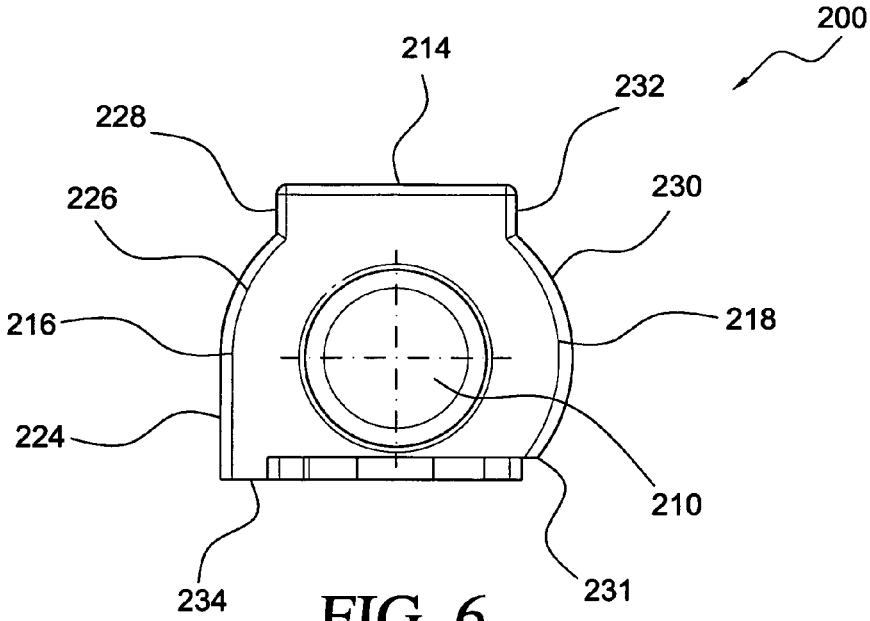
FIG. 6 is an end elevational view of the first embodiment of the new and improved cover or boot as illustrated within FIG. 5 and as viewed from the cylinder end of the cover or boot.
Figure 7:
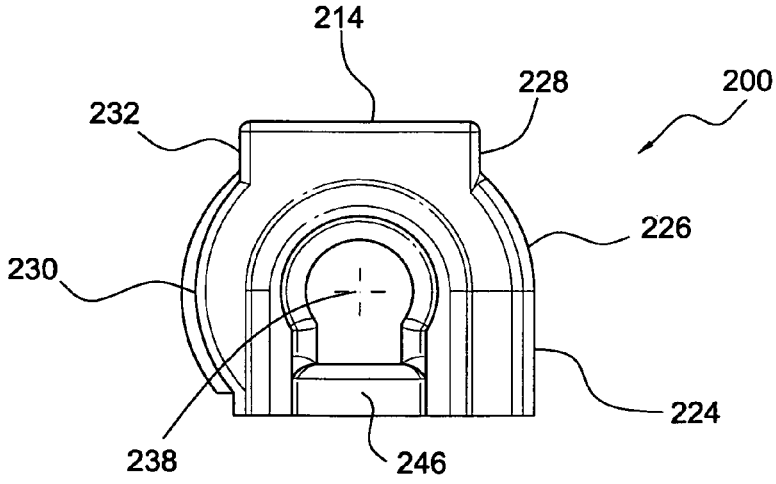
FIG. 7 is an end elevational view of the first embodiment of the new and improved cover or boot as illustrated within FIG. 5 and as viewed from the piston end of the cover or boot.

More particularly, as can best be appreciated from, for example, FIGS. 2 and 6, the left side wall member 216 of the central housing section 202 comprises a substantially planar inner side wall portion 224 which is adapted to engage, or be positioned closest to, the platform section 134 of the nosepiece assembly 108 of the fastener-driving tool 100, a substantially arcuately configured intermediate side wall portion 226 connected at its inner edge portion thereof to an outer edge portion of the substantially planar inner side wall portion 224, and a substantially planar outer side wall portion 228 which integrally connects the outer edge portion of the substantially arcuately configured inner side wall portion 226 to the top wall member 214. It is to be appreciated that the use of the terminology "inner", "outer", "upper", "lower", and the like, is to be considered in the context of, or from the point of view of, the orientation of the cover or boot 200 as illustrated within FIGS. 2 and 6, and as also considered from the point of view of the orientation of the cover or boot 200 when the cover or boot 200 is actually disposed upon or over the nail advancement mechanism 133 so as to cover, enclose, or encase the same when the nail advancement mechanism 133 is mounted upon the platform section 134 of the nosepiece assembly 108 of the fastener-driving tool 100 as illustrated within FIG. 1.

In a similar manner, it is likewise seen that the right side wall member 218 of the central housing section 202 comprises a substantially arcuately configured side wall portion 230 and an outer planar side wall portion 232 which integrally connects the outer edge portion of the substantially arcuately configured side wall portion 230 to the top wall member 214. It is noted that the inner edge portion 231 of the substantially arcuately configured side wall portion 230 of the right side wall member 218, as can best be seen in FIG. 6, terminates at a position which is located slightly more remote from the platform section 134 of the nosepiece assembly 108 of the fastener-driving tool 100, when the cover or boot 200 is actually disposed upon or over the nail advancement mechanism so as to cover, enclose, or encase the same, than the inner edge portion of the substantially planar inner side wall portion 224, and accordingly, the lower wall member 220 of the central housing section 202 has, in effect, a dependent leg portion 234 formed within the left corner region thereof. It is also noted that the lower end portions of the side wall portions 224,226,230 also transition or expand laterally or transversely outwardly, with respect to the longitudinal axis L of the cover or boot 200, such that the width dimension W of the cover or boot 200 is greatest at the lower end portion of the central housing section 202 as can best be appreciated, for example, from FIG. 9.

It is also noted, with respect to the central housing section 202 of the cover or boot 200, that the upper region of the substantially planar inner side wall portion 224 is provided with an arcuately configured aperture 236 so as to effectively accommodate an exhaust conduit, not shown, that leads from the combustion chamber of the fastener-driving tool 100 into the piston-cylinder assembly of the nail advancement mechanism 133 of the fastener-driving tool 100. In this manner, a portion of the exhaust gases from the combustion chamber of the fastener-driving tool 100 can actuate the piston member of the piston-cylinder assembly of the nail advancement mechanism 133 of the fastener-driving tool 100 in a first direction, while the spring member of the nail advancement mechanism 133, disposed or accommodated within internal chamber 212 of the lower housing section 210 of the cover or boot 200, can actuate the piston member of the piston-cylinder assembly of the nail advancement mechanism 133 in a second opposite direction. The piston-cylinder assembly of the nail advancement mechanism is of course provided with suitable means for permitting the exhaust gases to be vented to atmosphere when, for example, the spring member of the nail advancement mechanism 133 is actuating the piston member of the piston-cylinder assembly of the nail advancement mechanism 133 in the second opposite direction. It is also to be appreciated that the provision or disposition of the cover or boot 200 upon or over the nail advancement mechanism 133 of the fastener-driving tool 100 does not interfere with such venting of the exhaust gases to atmosphere.

Continuing further, it is seen that the lower housing section 210 has a substantially cylindrical configuration as can best be appreciated from FIGS. 2 and 9, however, as can best be appreciated from FIG. 8, it is seen that the upper housing section 206 comprises an upper end wall member 238, a substantially planar left side wall member 240, a substantially planar right side wall member 242, and a substantially arcuately configured top wall member 244. The free edge or inner portions of the substantially arcuately configured top wall member 244 are effectively seated upon and are integrally formed with the outer edge portions of the substantially planar left and right side wall members 240, 242, and an upper toe or nose member 246, having a substantially semi-cylindrical cross-sectional configuration, is effectively mated to or integrally formed with the upper edge portions of the left and right side wall members 240,242, as can best be appreciated from FIGS. 8 and 9. In a similar manner, it is also seen, as can best be appreciated from FIGS. 3-5 and 7-9, that a transitional housing section 248 effectively interconnects the central housing section 202 to the upper housing section 206. The structural configuration of the transitional housing section 248 is similar to that of the upper housing section 206 in that the transitional housing section 248 comprises an upper end wall member 250, a substantially planar left side wall member 252, a substantially planar right side wall member 254, and a substantially arcuately configured top wall member 256, however, the overall width dimension of the transitional housing section 248 is intermediate the respective width dimensions of the central housing section 202 and the upper housing section 206.

Continuing still further, it is to be appreciated from the foregoing that the various structural components, that is, for example, the various housing sections, wall members, and the like, comprising the first embodiment of the new and improved cover or boot 200, are specifically configured so as to effectively correspond to the various configurations of the various structural components, sections, portions, regions, and the like, of the piston and cylinder members of the piston-cylinder assembly of the nail advancement mechanism 133 of the fastener-driving tool 100. It is also to be recalled that the first embodiment of the new and improved cover or boot 200 comprises a molded structure which is fabricated from a suitable rubber composition, such as, for example, butadiene, neoprene, and the like.

Therefore, when the first embodiment of the new and improved cover or boot 200 is disposed over or upon the nail advancement mechanism 133 of the fastener-driving tool 100, the first embodiment of the new and improved cover or boot 200 will effectively naturally conform to the various structural components, sections, portions, regions, and the like, of the piston and cylinder members of the piston-cylinder assembly of the nail advancement mechanism 133 of the fastener-driving tool 100, with a relatively tight fit. However, it is also known that when such fastener-driving tools 100 are utilized in the field, on construction sites, and the like, the fastener-driving tools 100 are often subjected to substantial abuse by the workmen or operators during the ordinarily or commonly performed fastener installation procedures. Accordingly, despite the aforenoted relatively tight fit of the first embodiment new and improved cover or boot 200 upon, or with respect to, the nail advancement mechanism 133 of the fastener-driving tool 100, it is possible that the cover or boot 200 could be dislodged or disengaged from the nail advancement mechanism 133 of the fastener-driving tool 100 whereby the nail advancement mechanism 133 of the fastener-driving tool 100 would then be exposed and effectively unprotected from dust, particles, debris, and the like, which is often generated as a result of the insertion of fasteners into various different substrates.

Figure 10:
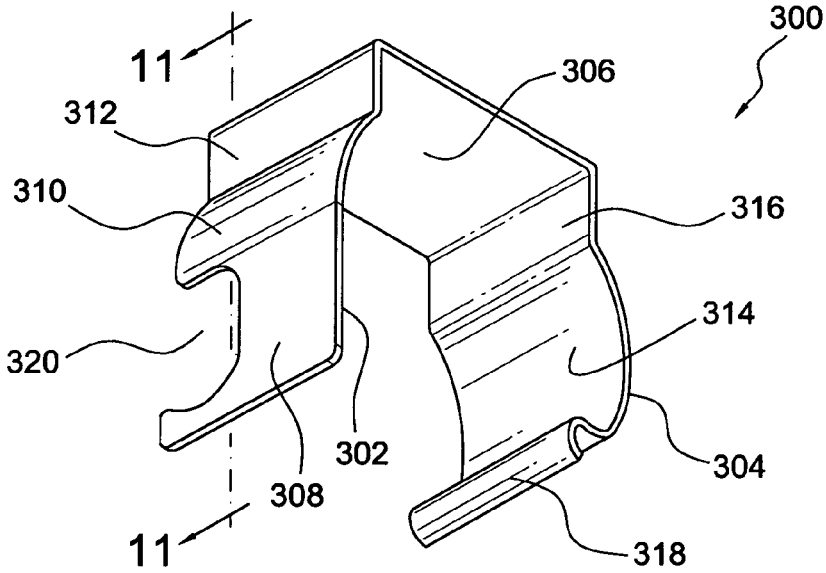
FIG. 10 is a perspective view of a new and improved spring clip which is utilized to fixedly secure the first embodiment of the new and improved cover or boot, as illustrated, for example, within FIG. 2, onto the fastener-driving tool as illustrated within FIG. 1.
Figure 11:
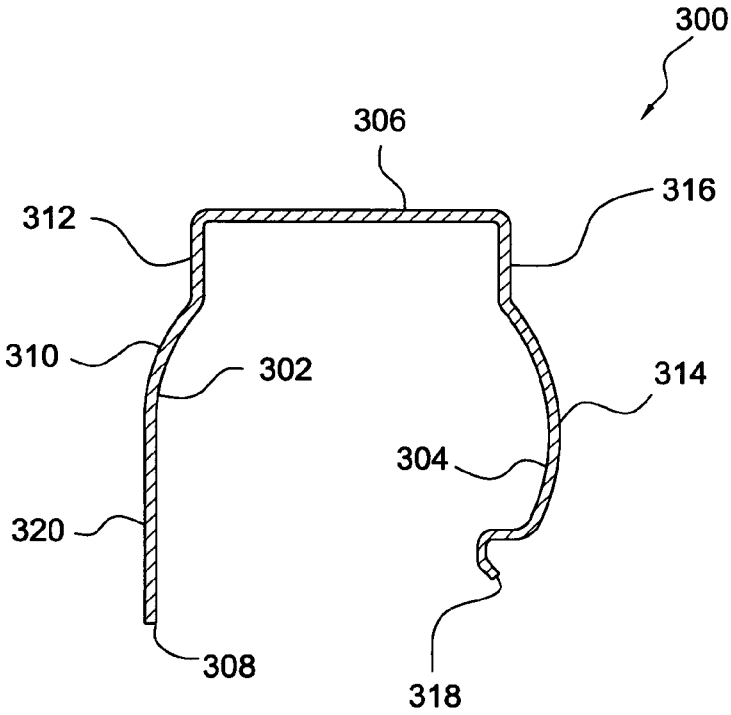
FIG. 11 is a cross-sectional view of the new and improved spring clip as illustrated within FIG. 10 and as taken along the lines 11-11 of FIG. 10.
Figure 12:
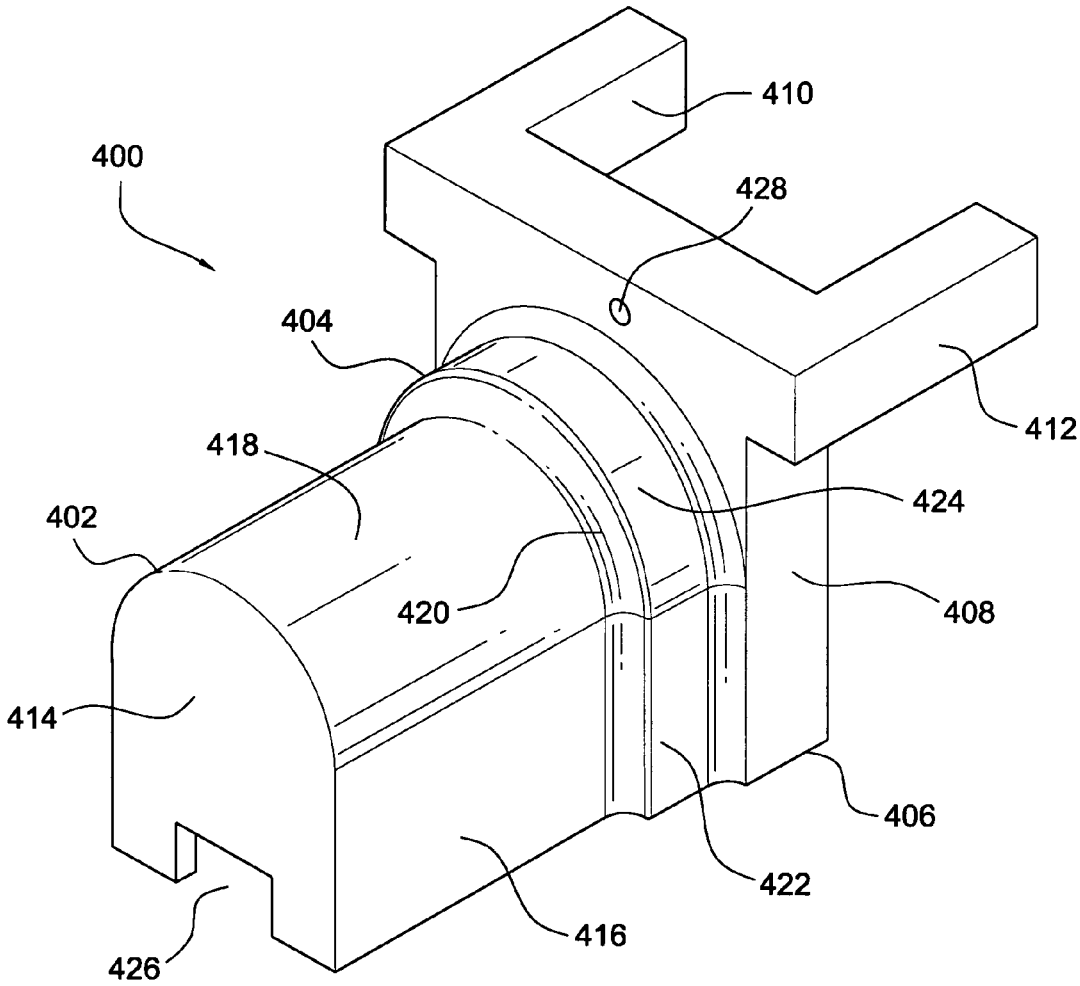
FIG. 12 is a perspective view of a second embodiment of a new and improved cover or boot which has also been constructed in accordance with the principles and teachings of the present invention, and which is viewed from the piston rod end and left side portion of the cover or boot, wherein the new and improved cover or boot may likewise be mounted upon the fastener-driving tool so as to effectively cover those regions of the nail advancement mechanism of the fastener-driving tool upon which dust, particles, debris, or the like, tend to collect and thereby prevent such dust, debris, particles, or the like, from effectively entering the piston-cylinder assembly of the nail advancement mechanism and thereby fouling or otherwise operatively interfering with the reciprocal movements of the piston rod of the piston-cylinder assembly of the nail advancement mechanism.

With reference therefore now being made to FIGS.10 and 11, a new and improved spring clip member, for securing the first embodiment new and improved cover or boot 200 onto the nail advancement mechanism 133 of the fastener-driving tool 100, is disclosed and is generally indicated by the reference character 300. More particularly, the spring clip member 300 is fabricated from a suitable flexible, resilient metal material, such as, for example, spring steel, and it is seen that the spring clip 300 comprises a three-sided structure which comprises a left side wall member 302, a right side wall member 304, and a top wall member 306. As can readily be seen, it is to be further appreciated that the left side wall member 302 comprises a substantially planar inner side wall portion 308 which substantially corresponds, for example, in depth to the substantially planar inner side wall portion 224 of the cover or boot 200, a substantially arcuately configured intermediate side wall portion 310 which substantially corresponds to the substantially arcuately configured intermediate side wall portion 226 of the cover or boot 200, and a substantially planar outer side wall portion 312 which substantially corresponds to the substantially planar outer side wall portion 228 of the cover or boot 200, it again being noted that the use of the terminology "inner", "outer", "upper", "lower", and the like, is to be considered in the context of, or from the point of view of, the orientation of the cover or boot 200 as illustrated within FIGS. 2 and 6, and the orientation of the spring clip member 300 as illustrated within FIGS. 10 and 11, when the cover or boot 200 is actually disposed upon or over the nail advancement mechanism 133 so as to cover, enclose, or encase the same when the nail advancement mechanism 133 is mounted upon the platform section 134 of the nosepiece assembly 108 of the fastener-driving tool 100 as illustrated within FIG. 1, and when, in turn, the spring clip member 300 is disposed upon or over the cover or boot 200.

In a similar manner, the right side wall member 304 comprises a substantially arcuately configured side wall portion 314 which substantially corresponds to the substantially arcuately configured side wall portion 230 of the cover or boot 200, an outer planar side wall portion 316 which substantially corresponds to the outer planar side wall portion 232 of the cover or boot 200, and the inner or lower edge portion of the substantially arcuately configured side wall portion 314 of the spring clip member is provided with a laterally or transversely inwardly extending lip member 318 that is adapted to engage the inner edge portion 231 of the substantially arcuately configured side wall portion 230 of the right side wall member 218 of the cover or boot 200 when the spring clip member 300 is mounted upon or over the cover or boot 200. Accordingly, it can be appreciated still further that when in fact the spring clip member 300 is mounted upon or over the cover or boot 200, it will, in effect, be snap-fitted thereon or thereover, upon the central housing section 202 of the cover or boot 200, such that the top wall member 306 will, for example, be seated upon the top wall member 214 of the cover or boot 200. In this manner, the spring clip member 300 will effectively grip or grasp the underlying structure comprising the nail advancement mechanism 133 of the fastener-driving tool 100, thereby effectively sandwiching the boot or cover 200 between the spring clip member 300 and the underlying structure comprising the nail advancement mechanism 133 of the fastener-driving tool 100 so as to fixedly retain the cover or boot 200 upon the nail advancement mechanism 133 of the fastener-driving tool 100. It is also noted that the substantially planar inner side wall portion 308 of the spring clip member 300 is provided with an aperture 320 which corresponds to the aperture 236, formed within the substantially planar inner side wall portion 224 of the cover or boot 200, so as to permit the exhaust gas conduit, not shown, to pass therethrough.

A third difference between the second embodiment cover or boot 400 and the first embodiment cover or boot 200 resides in the fact that, due to the inherent differences comprising molding and machining techniques, the structure of the second embodiment cover or boot 400 does not conform or correspond as closely to the various structural components comprising the nail advancement mechanism 133 of the fastener-driving tool 100 as does the first embodiment cover or boot 200. More particularly, it is seen that while the second embodiment cover or boot 400 comprises an upper housing section 402 and an intermediate housing section 404 which respectively correspond to the upper housing section 206 and the transitional housing section 248 of the first embodiment cover or boot 200, the second embodiment cover or boot 400 does not comprise housing sections comparable or corresponding to the central housing section 202 or the lower housing section 210. To the contrary, it is seen that the intermediate housing section 404 is integrally connected to a lower framework section 406 which comprises a lower wall member 408 and a pair of leg members 410,412 which extend axially in the lower or downward direction from the outermost part of the lower wall member 406, it again being remembered that the use of the terminology "inner", "outer", "upper", "lower", and the like, is to be considered in the context of, or from the point of view of, the orientation of the cover or boot 400 when the cover or boot 400 is actually disposed upon or over the nail advancement mechanism 133 so as to cover, enclose, or encase the same when the nail advancement mechanism 133 is mounted upon the platform section 134 of the nosepiece assemsembly 108 of the fastener-driving tool 100 as illustrated within FIG. 1.

More particularly with respect to the actual structure comprising the second embodiment cover or boot 400, it is seen that the upper housing section 402 comprises an upper end wall member 414, a pair of oppositely disposed substantially planar inner side wall members, only the left side wall member 416 being visible, and a substantially arcuately configured top wall member 418. In a similar manner, it is seen that the intermediate housing section 404 comprises an upper end wall member 420, a pair of oppositely disposed substantially planar inner side wall members, only the left side wall member 422 being visible, and a substantially arcuately configured top wall member 424. The upper end wall member 414 of the upper housing section 402 is also seen to be provided with an aperture 426 so as to permit an uppermost structural member of the nail advancement mechanism 133, which is enclosed, for example, by means of the toe or nose portion 246 of the first embodiment cover or boot 200, to project outwardly from the nail advancement mechanism 133 of the fastener-driving tool 100. It can therefore be appreciated that when the second embodiment cover or boot 400 is disposed upon or over the nail advancement mechanism 133 of the fastener-driving tool 100, only approximately the upper half portion of the nail advancement mechanism 133 will actually be covered, encased, or enclosed. However, it has been found that such structure adequately protects the nail advancement mechanism 133 from the collection or accumulation of dust, particles, debris, or the like, thereon in that the second embodiment cover or boot 400 does in fact cover, encase, or enclose that portion of the nail advancement mechanism 133 where the piston rod, of the piston-cylinder assembly of the nail advancement mechanism 133, actually projects out from the piston cylinder of the piston-cylinder assembly of the nail advancement mechanism 133. This is the most important part of the nail advancement mechanism 133 which needs or requires protection against the collection or accumulation of the dust, particles, debris, or the like, in order to effectively prevent the fouling or jamming of the movement of the piston member with respect to the piston cylinder of the piston-cylinder assembly of the nail advancement mechanism 133.

It is to be further appreciated that, unlike the first embodiment cover or boot 200 which was fabricated from a suitably flexible and resilient rubber material, and therefore would readily conform to the various structural components comprising the nail advancement mechanism 133 so as to readily conform to the contours or configurations. Accordingly, suitable fasteners, such as, for example, as illustrated at 428, are utilized to fixedly secure the second embodiment cover or boot 400 onto the underlying nail advancement mechanism 133. In addition, suitable weatherstripping or other similar material, such as, for example, a suitable foam, may be utilized along the inner edge portions of the second embodiment cover or boot 400 in order to permit such inner edge portions to properly seat or engage the platform section 134 of the nosepiece assembly 108 of the fastener-driving tool 100.

Thus, it may be seen that in accordance with the principles and teachings of the present invention, there has been disclosed a new and improved cover or boot for the nail advancement mechanism of a fastener-driving tool wherein the cover or boot covers, encases, or encloses substantial external surface portions of the nail advancement mechanism of the fastener-driving tool so as to effectively prevent the deposit, collection, or accumulation of dust, particles, debris, or the like, thereon, wherein such dust, particules, debris, or the like were generated during the driving of fasteners into particular types of substrates. The cover or boot also prevents the ingress of such deposited, collected, or accumulated debris, dust, particles, or the like, into the internal regions of the nail advancement mechanism of the fastener-driving tool so as to effectively prevent the occurrence of malfunctions of the nail advancement mechanism which could adversely affect the cyclical operations of the fastener-driving tools. The cover may comprise, in effect, a boot fabricated, for example, from a suitable rubber material, such as, for example, butadiene or neoprene, or alternatively, the cover may comprise, in effect, a cover fabricated, for example, from a relatively hard thermoplastic material, such as, for example, NYLON® or the like.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. In combination, a nail advancement mechanism and a cover assembly for covering said nail advancement mechanism of a fastener-driving tool so as to prevent the accumulation of dust particles thereon, comprising:

a nail advancement mechanism, adapted to be interposed between a fastener magazine and a driver blade assembly of the fastener-driving tool, and comprising structural components which effectively provide said nail advancement mechanism with predetermined external structural configurations and physical characteristics; and a cover, comprising a substantially semi-cylindrical, substantially hollow shell having a top wall portion and dependent side wall members, for covering said nail advancement mechanism of the fastener-driving tool so as to prevent the accumulation of dust particles thereon;

wherein said cover is secured over said nail advancement mechanism of the fastener-driving tool as a result of the fabrication of said cover as a structural product which structurally conforms to said predetermined external structural configurations and physical characteristics of said structural components of said nail advancement mechanism and comprises at least one internally hollow recess defined within said substantially semi-cylindrical, substantially hollow shell for respectively accommodating said structural components, of said nail advancement mechanism of the fastener-driving tool, having said predetermined external structural configurations and physical characteristics.

2. The combination as set forth in claim 1, wherein said structural product comprising said cover comprises:

a first end section for enclosing a piston rod section of the nail advancement mechanism;

a central section for enclosing a piston cylinder section of the nail advancement mechanism; and a second end section for enclosing a spring member of the nail advancement mechanism.

3. The combination as set forth in claim 1, wherein:

said cover is fabricated from a resilient, pliable, and flexible material.

4. The combination as set forth in claim 3, wherein:

said cover is fabricated from a rubber material.

5. The combination as set forth in claim 4, wherein:

said rubber material is selected from group comprising butadiene and neoprene.

6. The combination as set forth in claim 1, wherein:

said cover is secured over the nail advancement mechanism of the fastener-driving tool by a resilient clip adapted to be snap-fitted onto said cover in order to, in turn, secure said cover onto the nail advancement mechanism disposed beneath said cover.

7. The combination as set forth in claim 6, wherein:

said resilient clip for securing said cover over the nail advancement mechanism comprises the fabrication of said resilient clip as a structural product which structurally conforms to the various structural configurations of the various structural components of said cover.

8. The combination as set forth in claim 7, wherein:

said resilient clip is fabricated from a resilient metal material.

9. The combination as set forth in claim 1, wherein:

said cover is fabricated from a thermoplastic material.

10. A fastener-driving tool, comprising:

a housing for containing a driver blade for driving a fastener out from said fastener-driving tool;

a magazine for containing a plurality of fasteners to be serially driven out from said fastener-driving tool by said driver blade;

a nail advancement mechanism interposed between said fastener magazine and said driver blade for advancing a leading one of the plurality of fasteners from said magazine to a position at which said driver blade can act upon the leading one of the plurality of fasteners in order to drive the leading one of said plurality of fasteners out from said fastener-driving tool, wherein said nail advancement mechanism comprises structural components which effectively provide said nail advancement mechanism with predetermined external structural configurations and physical characteristics; and a cover, comprising a substantially semi-cylindrical, substantially hollow shell having a top wall portion and dependent side wall members, for covering said nail advancement mechanism of said fastener-driving tool so as to prevent the accumulation of dust particles thereon;

wherein said cover is secured over said nail advancement mechanism of said fastener-driving tool as a result of the fabrication of said cover as a structural product which structurally conforms to said predetermined external structural configurations and physical characteristics of said structural components of said nail advancement mechanism and comprises at least one internally hollow recess defined within said substantially semi-cylindrical, substantially hollow shell for respectively accommodating said structural components of said nail advancement mechanism of said fastener-driving tool having said predetermined external structural configurations and physical characteristics.

11. The fastener-driving tool as set forth in claim 10, wherein said structural product comprising said cover comprises:

a first end section for enclosing a piston rod section of the nail advancement mechanism;

a central section for enclosing a piston cylinder section of the nail advancement mechanism; and a second end section for enclosing a spring member of the nail advancement mechanism.

12. The fastener-driving tool as set forth in claim 10, wherein:

said cover is fabricated from a resilient, pliable, and flexible material.

13. The fastener-driving tool as set forth in claim 12, wherein:

said cover is fabricated from a rubber material.

14. The fastener-driving tool as set forth in claim 13, wherein:

said rubber material is selected from group comprising butadiene and neoprene.

15. The fastener-driving tool as set forth in claim 10, wherein:

said cover is secured over said nail advancement mechanism of said fastener-driving tool by a resilient clip which is adapted to be snap-fitted onto said cover in order to, in turn, secure said cover onto said nail advancement mechanism disposed beneath said cover.

16. The fastener-driving tool as set forth in claim 15, wherein:

said resilient clip for securing said cover over said nail advancement mechanism comprises the fabrication of said resilient clip as a structural product which structurally conforms to the various structural configurations of the various structural components of said cover.

17. The fastener-driving tool forth in claim 16, wherein:

said resilient clip is fabricated from a resilient metal material.

18. The fastener-driving tool as set forth in claim 10, wherein:

said cover is fabricated from a thermoplastic material.

* * * * *